US005836467A

United States Patent [19]

Montgomery

[11] Patent Number: 5,836,467

[45] Date of Patent: Nov. 17, 1998

[54] DOUBLE-SHELL CLOSURE HAVING AN ARCUATE GROOVE

[75] Inventor: Gary V. Montgomery, Evansville, Ind.

[73] Assignee: Rexam Plastics Inc., Evansville, Ind.

[21] Appl. No.: 862,077

[22] Filed: May 22, 1997

[51] Int. Cl.[6] ..... B65D 55/02

[52] U.S. Cl. ..... 215/216; 215/334

[58] Field of Search ..... 215/216, 217, 215/334

[56] References Cited

U.S. PATENT DOCUMENTS

| | | | |
|---|---|---|---|
| 1,577,019 | 3/1926 | Hammer . | |
| 2,423,582 | 7/1947 | Coleman . | |
| 3,079,022 | 2/1963 | Tompkins . | |
| 3,606,063 | 9/1971 | Childs et al. . | |
| 3,848,761 | 11/1974 | Libit . | |
| 4,116,351 | 9/1978 | Uhlig | 215/216 |
| 4,310,101 | 1/1982 | Sekine . | |
| 4,535,906 | 8/1985 | Rowekamp . | |
| 4,763,804 | 8/1988 | O'Connell . | |
| 5,207,341 | 5/1993 | Yeager | 215/334 |
| 5,236,101 | 8/1993 | Dugmore . | |
| 5,460,283 | 10/1995 | MaCartney et al. . | |
| 5,603,421 | 2/1997 | Opresco | 215/217 |

*Primary Examiner*—Stephen K. Cronin
*Attorney, Agent, or Firm*—Middleton & Reutlinger; Daniel C. Stelter, Esq.

[57] ABSTRACT

A closure is provided having concentric inner and outer spaced cylindrical shells attached at respective first distal ends thereof by a circular top wall. An arcuate groove is provided in an upper surface of the top wall integral with the inner cylindrical shell.

6 Claims, 5 Drawing Sheets

DOUBLE-SHELL CLOSURE HAVING AN ARCUATE GROOVE

BACKGROUND OF THE INVENTION

1. Technical Field of the Invention

The present invention relates to closures for use on containers. More particularly, the present invention relates to closures for use on containers wherein flexibility of the closure is enhanced by providing shell coring thereon.

2. Discussion of the Prior Art

Closures which "lock" onto an open end of a container neck (and thereby prevent easy access to the contents of the container) are relatively well known in the prior art, and the means by which such closures are "locked" onto their respective container necks varies widely. One such "locking" means is provided by a closure having concentric inner and outer cylindrical shells attached at first respective distal ends thereof by a continuous circular wall. The inner cylindrical shell is provided with internal threading on an inner surface thereof which is engageable with external threading provided on an external surface of a container neck. The outer cylindrical shell is provided with opposed downwardly-depending locking lugs which are engageable with mating locking lugs provided on the external surface of the container neck.

To "unlock" the closure of this style from its cooperating container neck, the outer cylindrical shell must be radially distorted sufficiently to permit the downwardly-depending closure lugs to pass outwardly beyond container neck locking lugs. Thus, the stiffness, weight and flexibility of the closure are all significant properties of the closure design which define the ease with which such radial distortion is to be achieved.

Various enhancements to closures of this general design have been proposed by the prior art, all of which attempt to maximize the strength, integrity and flexibility of the closure while simultaneously minimizing the stiffness, weight and production costs associated therewith. For example, U.S. Pat. No. 3,848,761 to Libit teaches the use of an inner cylindrical shell in combination with a separate outer cylindrical shell to permit sufficient axial distortion of the locking lugs without requiring equivalent distortion of the stiff internal threading integrally molded on an inner surface of the inner cylindrical shell. However, the use of the inner cylindrical shell requires additional material, thereby increasing the weight of the product, as well as the production costs associated therewith.

Further, various enhancements to the so-called double-shell closures, for example, such as the closure which is the subject matter of the above '761 patent to Libit, have been proposed by the prior art to reduce stiffness, material usage and production costs. The above '761 patent to Libit further teaches the use of arcuate slots provided through a top wall which joins the inner and outer cylindrical shells and reduces overall axial stiffness of the closure, thereby permitting axial distortion of the outer cylindrical wall relative to the inner cylindrical wall sufficient to "unlock" the closure from the container neck.

SUMMARY OF THE INVENTION

It is an object of the present invention to provide a closure for use on a container, wherein the closure is sufficiently rigid to prevent easy access to the contents of the container, yet sufficiently flexible to permit controlled access therein.

It is another object of the present invention to provide a closure for use on a container, wherein the closure can be manufactured through a relatively low-cost process.

A closure according to the present invention includes a top wall, an outer shell disposed towards an outer perimeter of the top wall and an inner shell disposed inwardly from and concentrically with the outer wall. The inner and outer shells depend downwardly from a lower surface of the top wall. The top wall includes a circular groove, usually continuous, therein disposed on an upper surface thereof integral with the inner shell. A pair of opposed locking lugs depend downwardly from a lower end of the outer shell and are sized to engage cooperating locking lugs provided on an exterior surface of a container. An internal thread is provided on an inner surface of the inner shell and is sized to engage a cooperating external thread provided on the exterior surface of the container.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENT

Figure 1:
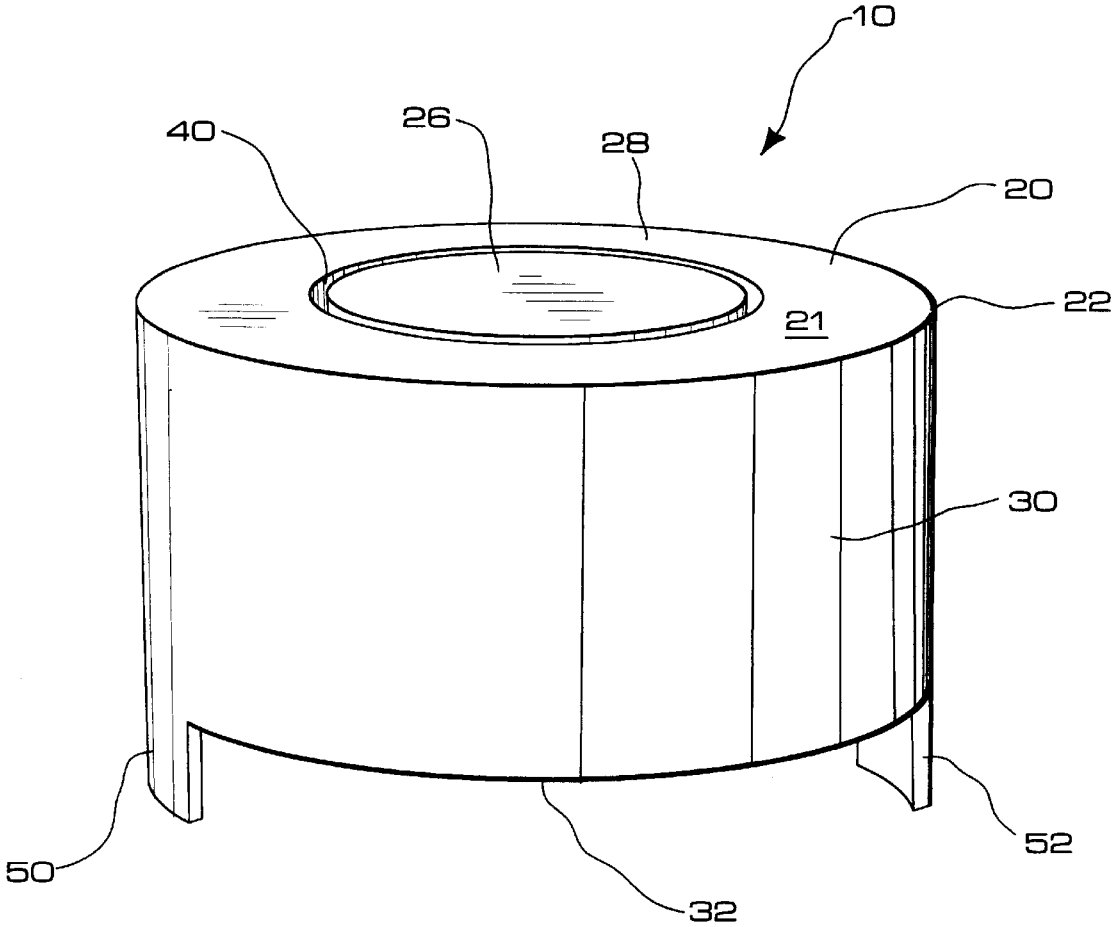
FIG. 1 is a top perspective view of a preferred closure according to the present invention.

With reference to FIG. 1, a closure 10 according to the preferred embodiment of the present invention is shown to include a top wall 20 and an outer shell 30 depending downwardly from an outer perimeter 22 of the top wall 20. The top wall 20 includes a continuous arcuate groove 40 disposed in an upper surface 21 thereof concentric with the inner shell 60, groove 40 defining a top wall inner portion 26 and a top wall outer portion 28. A pair of lugs 50 and 52 project axially downwardly from a lower end 32 of the outer shell 30 opposite the top wall 20 and are sized to engage cooperating locking lugs provided on an exterior surface of a container (not shown).

Figure 2:
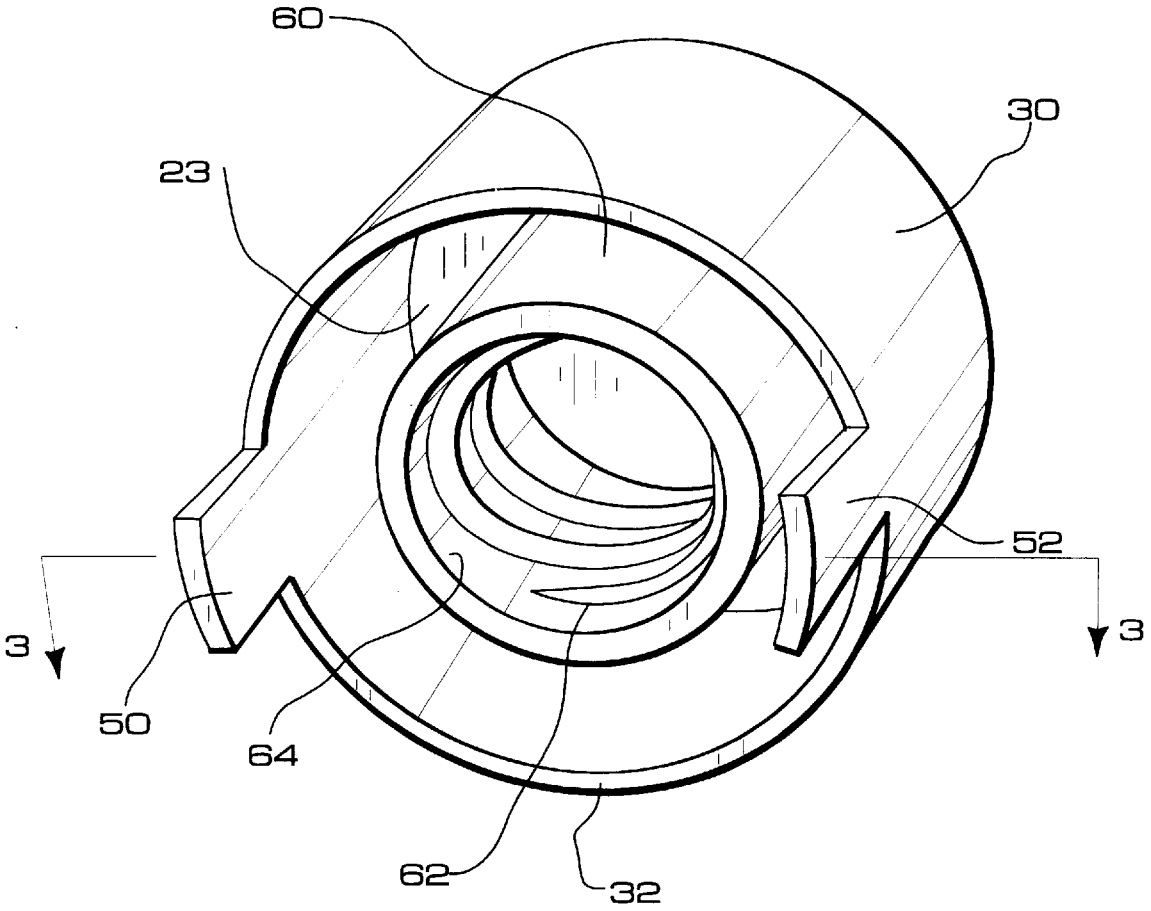
FIG. 2 is a bottom perspective view of the preferred closure according to the present invention of FIG. 1.
Figure 3:
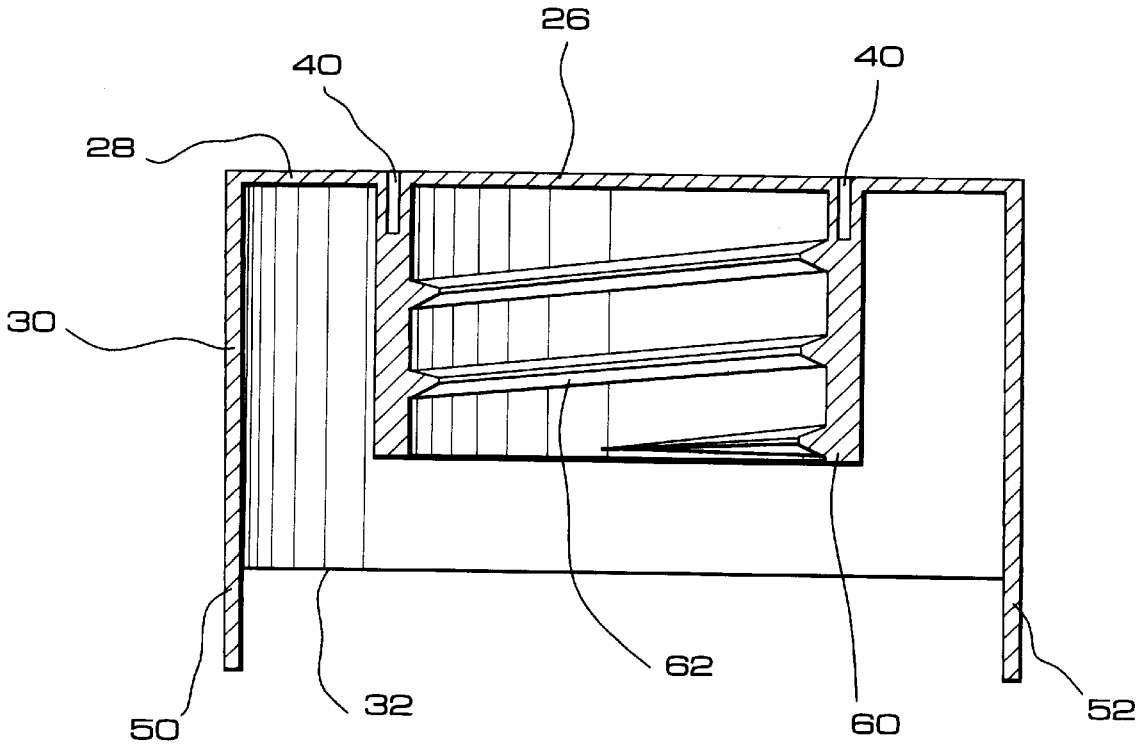
FIG. 3 is a side section view of the preferred closure according to the present invention taken along section line A—A of FIG. 2.

With reference to FIG. 2, the closure 10 includes an inner shell 60 depending downwardly from a lower surface 23 of the top wall 20. The inner shell 60 is radially disposed immediately beneath and integral with the circular groove 40 (FIG. 3). Inner shell 60 includes an internal thread 62 disposed on an inner surface 64 thereof which is sized to engage a cooperating external thread on the exterior surface of the container (not shown).

In use, a user applies inwardly directed radial forces towards an upper end of the outer shell 30 at opposed locations offset from the lugs 50 and 52 by about 90°. The inward distortion of the outer shell 30 at the locations of the applied inwardly-directed forces causes the outer shell 30 to be distorted outwardly at locations on the outer shell 30 coincident with the lugs 50 and 52, thereby permitting the lugs 50 and 52 to overcome their respective container lugs (not shown).

The arcuate groove 40 permits the outer shell 30 to distort significantly inwardly without requiring equivalent distortion of the inner shell 60. Due to the fact that the internal thread 62 of the inner shell 60 stiffens the inner shell 60 substantially, the amount of force required to be applied to achieve the same amount of radial distortion of the lugs 50 and 52 is lessened.

The closure 10 is made from any suitable closure material, such as, for example, integrally-molded polypropylene. Further, due to the fact that less material is used in forming the closure 10, production costs are lowered. Due further to the fact that less material is used, each closure manufactured according to the preferred embodiment of the present invention weighs less than a representative closure of the prior art. Even further, due to the fact that the arcuate groove 40 reduces the amount of material comprising a closure manufactured according to the preferred embodiment of the present invention requires less time to cool, overall manufacturing time thereof is reduced.

Figure 4:
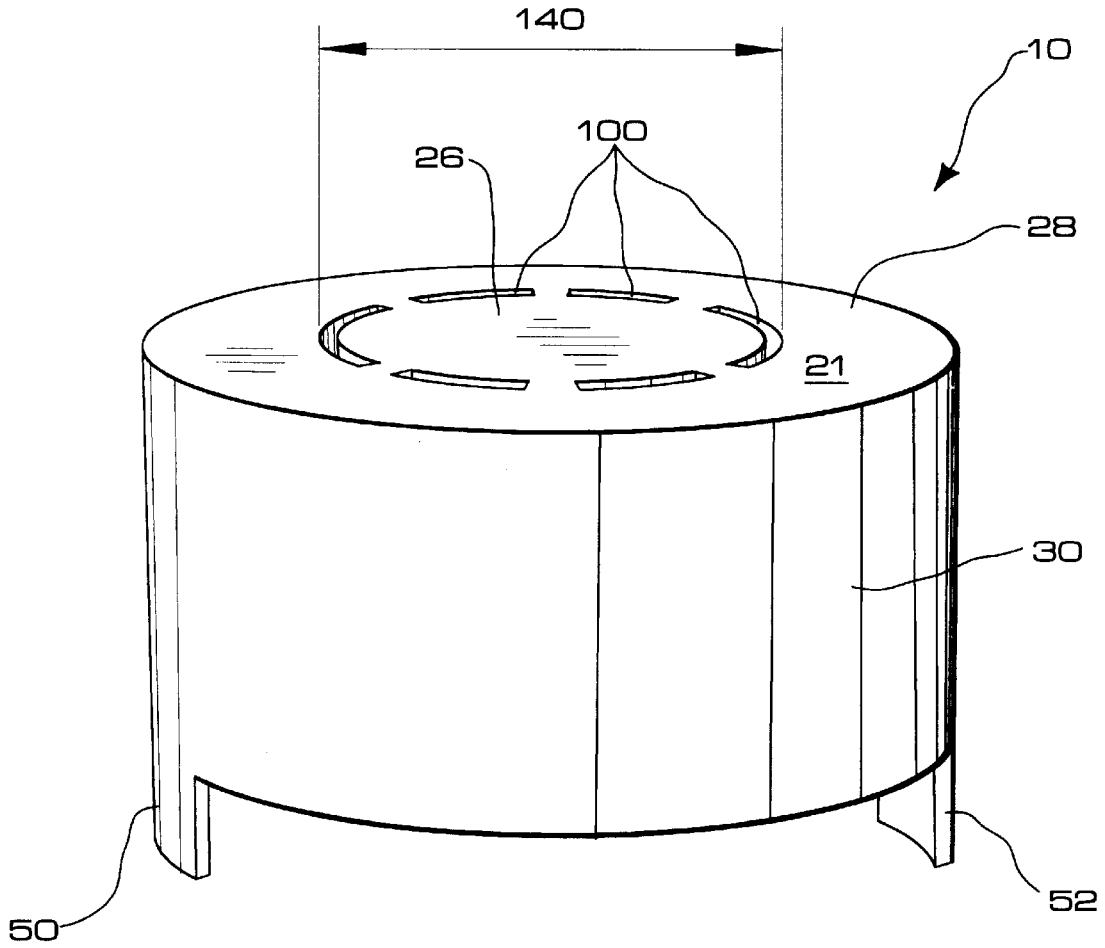
FIG. 4 is a top perspective view of another embodiment of the present invention, showing a plurality of elongated arcuate grooves; and, FIG. 5 is a top perspective view of another embodiment of the present invention, showing opposed, radially outwardly-projecting locking lugs.

In another embodiment of the present invention as shown in FIG. 4, the arcuate groove includes a plurality of arcuate groove sections 100 which cooperate to form a discontinuous circular groove 140.

Figure 5:
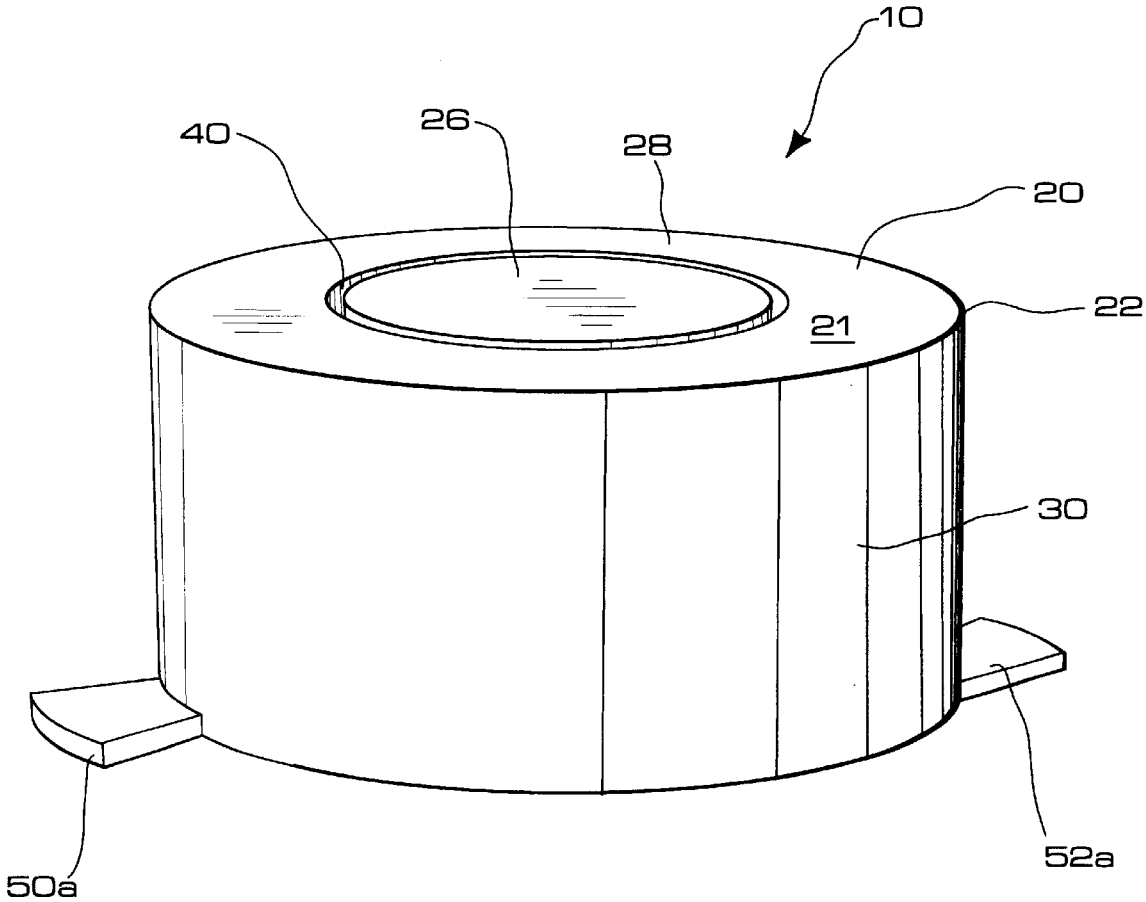

In yet another embodiment of the present invention as shown in FIG. 5, the closure 10 includes a pair of opposed locking lugs 50*a* and 52*a* projecting outwardly from an outer surface of the outer shell 30 which are sized to engage a pair of locking lugs provided on an exterior surface of a container (not shown). Alternatively, the locking lugs 50*a* and 52*a* may project inwardly from an inner surface of the outer shell 30.

The foregoing detailed description is given primarily for clearness and understanding and no unnecessary limitations are to be understood therefrom for modifications will become obvious to those skilled in the art upon reading this disclosure and may be made without departing from the spirit of the present invention.

I claim:

1. A closure, comprising:

a top wall having an outer diameter;

an outer shell depending downwardly from a lower surface of said top wall;

an inner shell depending downwardly from said lower surface and disposed concentrically with and spaced inwardly from said outer shell; and, an arcuate groove disposed in an upper surface of said top wall depending downwardly towards said inner shell.

2. A closure according to claim 1, wherein:

said inner shell includes an inner surface having an internal thread provided thereon.

3. A closure according to claim 1, wherein:

said outer shell includes a pair of lugs projecting downwardly from an end of said outer shell opposite said top wall.

4. A closure according to claim 1, wherein:

said outer shell includes a pair of lugs projecting outwardly from an outer surface of said outer shell near an end of said outer shell opposite said top wall.

5. The closure according to claim 1, said arcuate groove being a plurality of arcuate groove sections forming a discontinuous arcuate groove.

6. The closure according to claim 1, said arcuate groove being continuous along an upper surface of said top wall.

* * * * *